US005917532A

United States Patent [19]

Cornell et al.

[11] Patent Number: 5,917,532

[45] Date of Patent: Jun. 29, 1999

[54] THERMAL INK RIBBON CASSETTE FOR MAILING MACHINES

[75] Inventors: Edward P. Cornell, Newtown; Gerald C. Freeman, Norwalk; Jacky Y. Igval, Milford; Thomas M. Lyga, Torrington, all of Conn.

[73] Assignee: Pitney Bowes Inc., Stamford, Conn.

[21] Appl. No.: 08/758,405

[22] Filed: Nov. 29, 1996

[51] Int. Cl.[6] ..... B41J 35/36

[52] U.S. Cl. ..... 347/214; 400/693; 400/693.1

[58] Field of Search ..... 347/214, 197, 347/215; 400/207, 208, 235, 235.1, 693, 693.1; B41J 32/00, 35/36

[56] References Cited

U.S. PATENT DOCUMENTS

| | | | |
|---|---|---|---|
| 3,989,132 | 11/1976 | Carson, Jr. | 197/168 |
| 4,252,450 | 2/1981 | Goodman et al. | 400/208 |
| 4,397,574 | 8/1983 | Wojdyla | 400/196.1 |
| 4,490,059 | 12/1984 | Daughters | 400/208 |
| 4,611,218 | 9/1986 | Watanabe | 347/197 |
| 5,145,268 | 9/1992 | Cavallini | 400/196.1 |
| 5,415,482 | 5/1995 | Poole et al. | 400/248 |
| 5,459,504 | 10/1995 | Sato | 347/215 |
| 5,471,235 | 11/1995 | Patry | 347/214 |
| 5,472,286 | 12/1995 | Uemura et al. | 400/196.1 |

*Primary Examiner*—David F. Yockey
*Assistant Examiner*—Anh T. N. Vo
*Attorney, Agent, or Firm*—Alberta A. Vitale; Angëlo N. Chaclas; Melvin J. Scolnick

[57] ABSTRACT

A thermal ink ribbon cassette for holding an inked ribbon of indefinite length for is in a thermal transfer printing mechanism is disclosed in which the cassette holds a spool of fresh ink ribbon which passes out of the cassette and across a thermal printing head, and then back into the cassette into a used ribbon chamber. A ribbon drive mechanism is mounted in the cassette adjacent the location on the cassette where the used ribbon normally enters the cassette so that if the ribbon breaks, the free broken end can be manually fed into the drive mechanism so that the remaining portion of the unused ribbon can be used. The cassette may also be provided with a removable front wall so that replacement ribbons can be inserted by a user, and a disposable container can be put into the ribbon take up chamber of the cassette so that a user does not have to handle the rumpled ink ribbon when changing to a new ribbon.

7 Claims, 3 Drawing Sheets

THERMAL INK RIBBON CASSETTE FOR MAILING MACHINES

BACKGROUND OF THE INVENTION

The present invention relates generally to the field of mailing machines, and more particularly to a cassette for use in mailing machines which encloses a disposable inked ribbon used in conjunction with a thermal transfer printing process by which the mailing machine prints a postage indicia on envelopes.

Mailing machines have long been well known and are in very widespread use in virtually all commercial, professional and even home applications which involve the handling of mail. Typically, a mailing machine includes a postage meter having a printing mechanism that prints a postage indicia on an envelope that is fed through the mailing machine in any suitable manner to evidence the payment of appropriate postage for depositing the envelope with the Postal Service. For a long period of time, the traditional method of printing the indicia has been by direct ink transfer from an engraved die bearing an image of the indicia, to which ink is applied by a variety of inking devices prior to each printing operation. The dies have been either curved and mounted on a rotatable drum so that printing can take place while an envelope is moving through the mailing machine, or have been flat and mounted on a movable mechanism that presses the die against an envelope while it is momentarily held stationary in a printing position within the mailing machine. In either event, after ink is applied to the die between successive or several printing operations, the ink is transferred to the envelope by direct pressure of the die against the surface of the envelope.

While these mailing machines enjoyed great success for a long period of time, the nature of the printing mechanisms has caused these machines to be relatively complex, large and therefore expensive, with the result that relatively small offices, business organizations, and even individuals, which involve relatively small volumes of mail, cannot economically justify the purchase and installation of these machines. Accordingly, recent mailing machine technology has been directed to alternative methods of printing postage indicia on envelopes in order to substantially reduce the complexity of mailing machines, reduce their size, and therefore in these and other ways greatly diminish the cost of purchase and maintenance.

One of the methods currently under development for use in mailing machines is that of thermal transfer of ink from an ink permeated ribbon in a selected image pattern to deposit ink on the surface of an envelope in the image of a postage indicia. In its simplest form, this method involves bringing the surface of an envelope and a ribbon that is permeated with suitable thermal transfer ink into intimate contact, and moving the envelope and ribbon combination beneath a thermal print head which has the capability of heating the inked ribbon selectively along a print line so that the ink is heated and transferred to the surface of the envelope in the desired image pattern. The thermal print head includes a plurality of minute heating elements spaced along the print line which are selectively actuated under the control of suitable software so as to heat the ribbon in a precisely controlled sequence which will produce the desired image on the envelope as the envelope and ribbon are moved relative to the print head.

This method of printing in general printing applications is not new, and has proved very successful. But when applied to the printing of postage indicia on envelopes by mailing machines, several problems unique to this use become apparent. One in particular is that the ink used to print the postage indicia is uniquely formulated for the intended purpose, as a result of which the ribbons are quite expensive. In addition, once used, special security techniques must be observed to prevent unscrupulous users from attempting to reuse the ribbons to obtain duplicate postage indicias for which they have not paid, thereby lending further expense to the cost of use of these ribbons. Another factor which contributes to the high cost of the ink ribbons is the necessity of packaging them in a suitable cassette which can be inserted into and removed from the mailing machine by the user in order to facilitate easy replacement of ribbons as they are used. Thus, it is seen that, although the complexity and cost of the equipment for thermal printing in mailing machines has greatly reduced the cost thereof, a substantial portion of the savings to the user is offset by the cost of constantly purchasing new ribbon cassettes.

One major problem that raises the user's cost in purchasing new ribbon cassettes is that of breakage of the ribbon during operation of the mailing machine. The ribbons are susceptible to breaking either from an envelope jamming in the printing area, thereby stalling the tape and causing the take up spool to apply excessive tension and breaking it, or the application of too much torque on the ribbon take up spool. With currently available cassettes, if for whatever reason a ribbon breaks, the broken end cannot be reinserted into the cassette, and consequently the user must replace the cassette, thereby wasting the unused portion of the ribbon in that cassette.

Thus, it is clear that there is a need for a relatively simple, inexpensive and easy to use cassette for holding a thermal ink ribbon in the thermal printing mechanism of a mailing machine which solves these problems.

BRIEF SUMMARY OF THE INVENTION

The present invention greatly obviates if not entirely eliminates the problems and disadvantages of prior art ribbon cassettes by providing a single cassette which solves each of the foregoing problems in a simple and effective manner.

It has been found that by redesigning the ribbon cassette to provide a ribbon drive adjacent the location on the cassette where the used ribbon normally enters the cassette, a broken ribbon can be manually fed back into the cassette so that the rest of the unused ribbon can then be used in the normal manner. It has also been found that the cassette can be made to open so that a fresh ribbon can be loaded into the cassette by a user, thereby eliminating the need to buy a new cassette each time a ribbon is consumed.

Thus, the present invention is a thermal ink ribbon cassette for holding an inked ribbon of indefinite length for use in a thermal transfer printing mechanism of a mailing machine. In this environment, the cassette comprises a plurality of walls defining a generally rectangular housing having a pair of adjacent interior chambers, and means in one of the chambers for rotatably holding a supply spool of thermal ink ribbon. There is means disposed on one side of the housing defining an exit opening from the chamber for the ink ribbon, and means disposed on the same side of the housing in spaced relationship with the exit opening and defining an entrance opening into the other chamber. There is means for guiding the ink ribbon from the exit opening of the one chamber to the entrance opening into the other chamber, and there is means mounted on the cassette adjacent the entrance opening into the other chamber for feeding the ink ribbon through the entrance opening into the other chamber. Thus, if the ink ribbon breaks, the broken end of the unused portion thereof can be inserted into the feeding means for continued feeding of the ink ribbon into the other chamber during continued use of the mailing machine containing the cassette.

In some of more limited aspects, the plurality of walls includes an interior wall which divides the interior of the housing into the pair of adjacent chambers. Also, the lower wall of the housing includes an upwardly projecting protrusion to define a downwardly opening cavity between the exit and entrance openings to accommodate the thermal print head of the printing mechanism when the cassette is inserted into the printing mechanism. The means for guiding the ink ribbon from the exit opening to the entrance opening comprises means formed on the lower wall for guiding the ink ribbon across the downwardly opening cavity so that the ink ribbon lies in a plane that is contiguous with the lower surface of the print head of the thermal printing mechanism when the cassette is inserted into the printing mechanism.

The means for feeding the ink ribbon through the entrance opening comprises a pair of feed rollers rotatably mounted on front and rear walls of the housing adjacent the entrance opening such that the nip of the feed rollers is readily accessible to receive the broken end of the unused portion of the ink ribbon. A finger knob is connected to the one feed roller for manually rotating the feed rollers to initiate feeding of the broken end of the ink ribbon into the other chamber. The one feed roller further includes a gear mounted on the other end thereof for engagement with a drive gear mounted in the printing mechanism when the cassette is inserted into the printing mechanism for driving the feed rollers. Also, the gear is connected to the feed roller through a one way clutch to prevent reverse rotation of the feed roller to prevent the ink ribbon already in the other chamber from being withdrawn therefrom.

In other embodiments of the invention, the cassette is provided with a removable front wall so that a user can insert fresh ink ribbon when the previous ribbon is consumed, thereby avoiding the necessity of buying a new cassette with each new ribbon. Further, a disposable container can be inserted into the used ribbon take up chamber of the cassette to collect the used ribbon so that the user does not have to handle the rumpled ribbon and contaminate his hands with ink.

Having briefly described the general nature of the present invention, it is a principal object thereof to provide a thermal ink ribbon cassette for use in a thermal transfer printing mechanism of a mailing machine in which the ink ribbon is both repairable and replaceable within the cassette to permit use of the entire ink ribbon if it breaks and user replacement of fresh ribbons.

It is another object of the present invention to provide a thermal ink ribbon cassette in which the free end of a broken ribbon can be reinserted into the cassette adjacent the used ribbon take up side of the cassette to permit continued use of the unused portion of the ribbon.

It is still another object of the present invention to provide a thermal ink ribbon cassettes which can be opened by an operator for replacement of a used ribbon by a fresh ribbon to avoid the necessity of buying a new cassette with each replacement ribbon.

These and other objects and advantages of the present invention will be more apparent from an understanding of the following detailed description of presently preferred embodiments of the invention when considered in conjunction with the accompanying drawings.

DETAILED DESCRIPTION OF THE INVENTION

Figure 1:
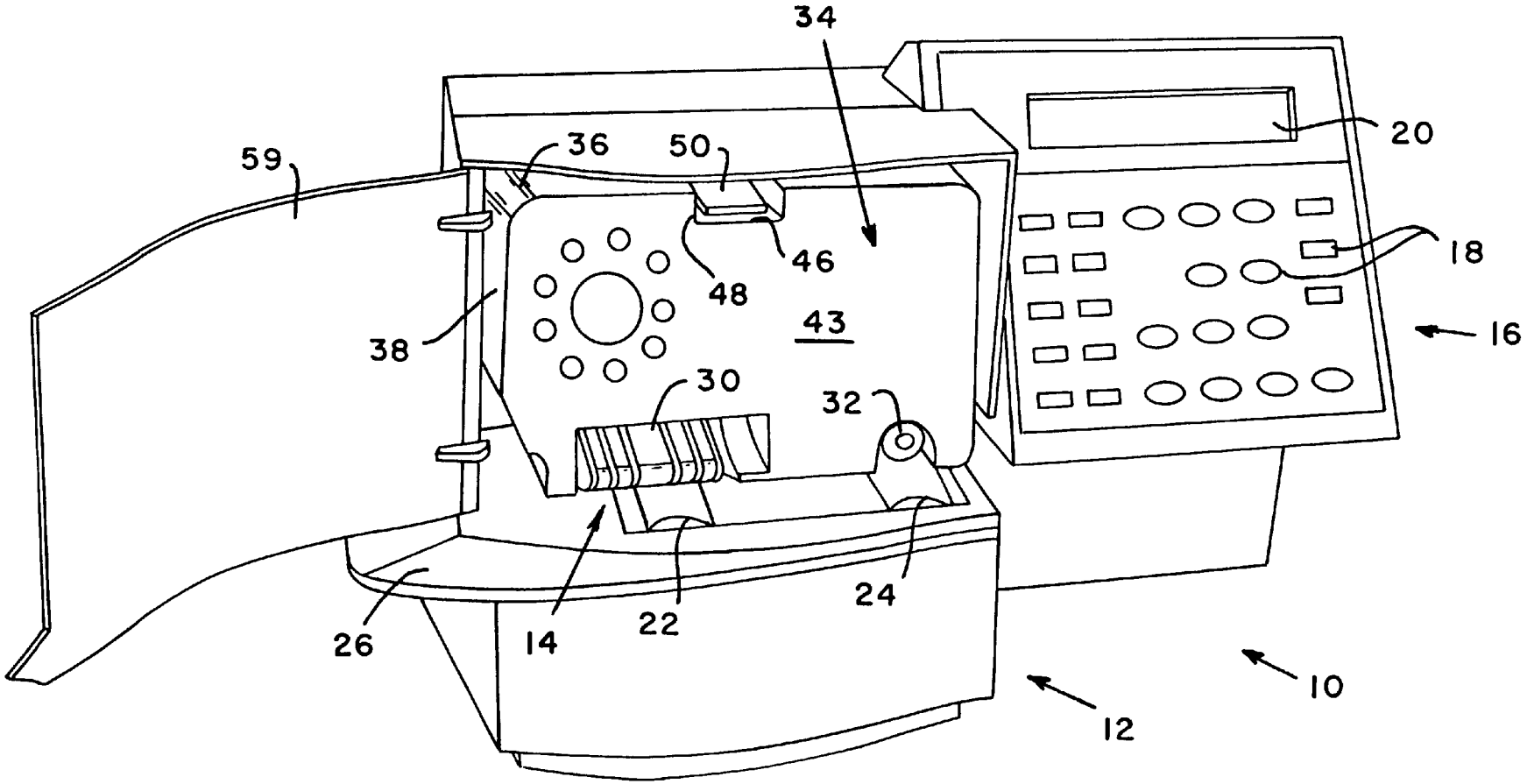
FIG. 1 is a perspective view of a mailing machine incorporating an ink ribbon cassette embodying the principles of the present invention.

Referring now to the drawings, and particularly to FIG. 1 thereof, there is seen a mailing machine, indicated generally by the reference numeral 10, which includes a base unit, indicated generally by the reference numeral 12, a thermal printing unit, indicated generally by the reference numeral 14, and a data input unit, indicated generally by the reference numeral 16, which includes a plurality of push buttons 18 for entering various information, such as weight, postal zone, and other information relevant to ascertaining the correct amount of postage which is to appear on a particular postage indicia. The data input unit 16 also includes an LCD display 20 for visual verification of the data entered into the unit 16.

The base unit 12 includes an envelope feeding apparatus which includes an infeed roller 22 and eject roller 24 mounted in the base unit 12 on a suitable frame both for rotation and for alternate reciprocating movement toward and away from a feed deck 26 on which an envelope is placed by an operator preparing to initiate a printing operation. The entire envelope feeding apparatus in the base unit 12 is fully shown and described in U.S. Pat. No. 5,325,114, issued Jun. 18, 1994 to Fogle et al and assigned to the assignee of this application. Reference is hereby made to that patent for further details of the envelope feeding apparatus, which need not be further shown or described herein since it forms no part of the present invention. For the purpose of this invention, it is only necessary note that when an envelope is placed on the feed deck 26 and pushed against a triggering device, the infeed roller 22 moves upwardly to press the upper surface of the envelope against an ink ribbon 28 shown in FIG. 2 and to press the ink ribbon 28 against the under side of a thermal print head 30. The infeed roller 22 then feeds the envelope and ink ribbon 28 together while maintaining the ink ribbon in contact with the print head 30, which in known manner selectively heats portions of the ink ribbon so as to deposit ink on the upper surface of the envelope in a desired image pattern, as controlled by a microprocessor and suitable software. After the printing operation is completed, the leading edge of the envelope is positioned over the eject roller 24, which during printing has been in a depressed position, and which now is raised into contact with the envelope to press the envelope against a back up roller 32. Simultaneously with the upward movement of the eject roller 24, the infeed roller 22 is depressed, thereby releasing the envelope for ejection by the eject roller 24 and the back up roller 32.

Figure 2:
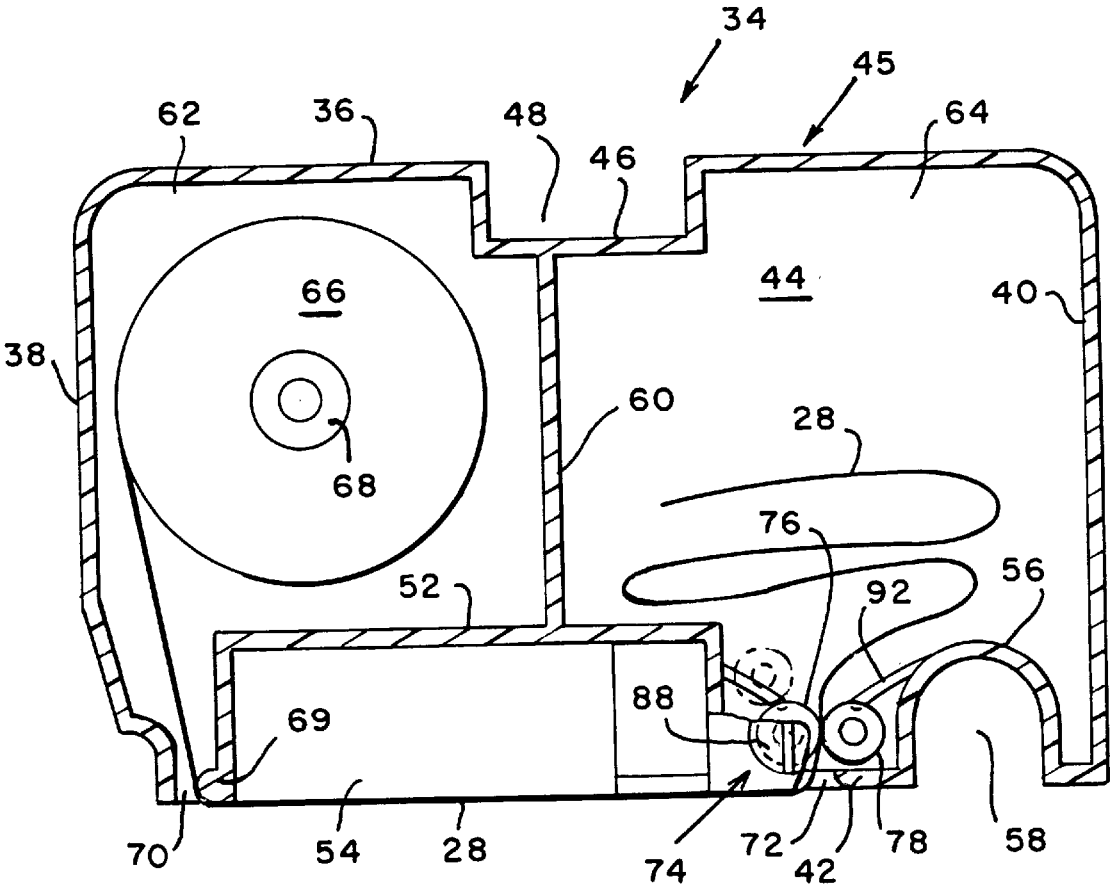
FIG. 2 is a front view of the ink ribbon cassette used in the mailing machine shown in FIG. 1.

With reference now to FIGS. 1 and 2, the ink ribbon cassette of the present invention, indicated generally by the reference numeral 34, is shown in operative position in the mailing machine 10 in FIG. 1, and is shown in section removed from the mailing machine in FIG. 2. The cassette 34 comprises a plurality of walls, including a top wall 36, end walls 38 and 40, a bottom wall 42 and front and rear walls 43 and 44 (FIG. 4), all of these walls defining a housing indicated generally by the reference numeral 45 which has a generally rectangular configuration. The top wall 36 includes a downwardly projecting portion 46 which provides an upwardly opening cavity 48 to accommodate a tab 50 which is part of the structure on the mailing machine 10 which secures the cassette 34 into the mailing machine, and which forms no part of the present invention. Also, the bottom wall 42 is provided with an upwardly projecting portion 52 which defines a downwardly opening cavity 54 which accommodates the print head 30 when the cassette 34 is inserted into the mailing machine 10. The bottom wall 42 is provided with a second upwardly projecting portion 56 which defines another downwardly opening cavity 58 which accommodates the back up roller 32 when the cassette 34 is inserted into the mailing machine 10. As seen in FIG. 1, a suitable door 59 is pivotally connected to the mailing machine 10 to enclose the cassette 34 and the print head 30.

The cassette 34 includes a vertically oriented wall 60 which extends between the downwardly projecting portion 46 of the top wall 36 and the upwardly projecting portion 52 of the bottom wall 42 to divide the space within the housing 45 into two adjacent chambers, a ribbon supply chamber 62 on the left as viewed in FIG. 2, and a ribbon take up chamber 64 on the right. A spool 66 of thermal ink ribbon 28 is rotatably mounted on a suitable spindle 68 affixed to the rear wall 44 of the cassette 34. The lower end of the end wall 38 and an edge portion 69 of the bottom wall 42 are spaced apart to define a narrow opening 70 which constitutes an exit opening for the ink ribbon 28 from the chamber 62. Also, the lower wall 42 is provided with a narrow slit 72 which constitutes an entrance opening into the ribbon take up chamber 64. It will be seen that the edge portion 69 of the bottom wall 42 and the adjacent edge of the slit 72 constitute a means for guiding the ink ribbon 28 across the cavity 54 which contains the print head 30 so that the ink ribbon 28 lies in a plane that is contiguous with the lower surface of the print head 30 when the cassette 34 is in its operating position in the printing mechanism of the mailing machine.

Figure 3:
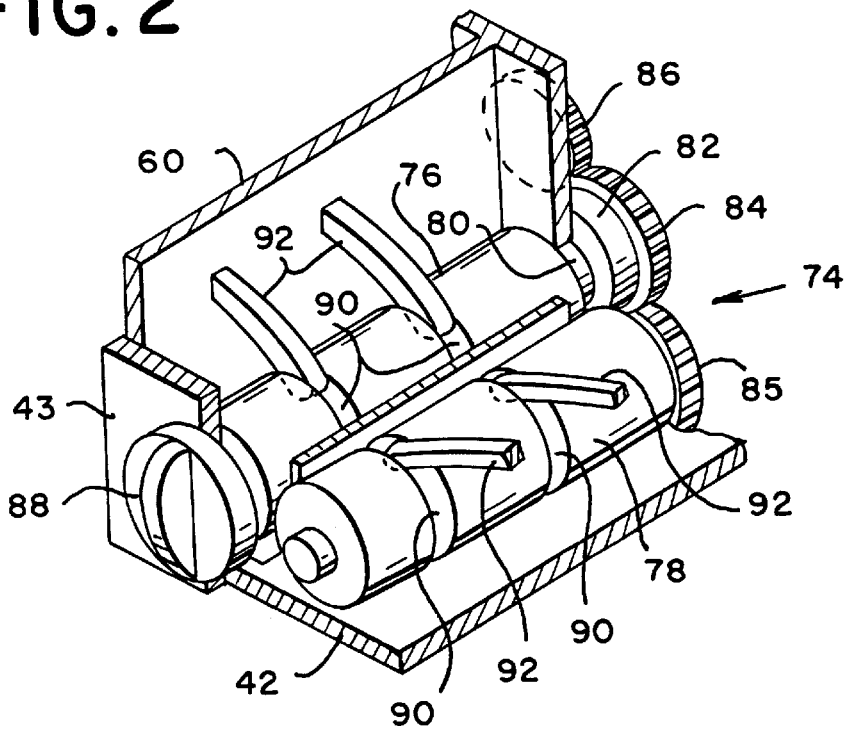
FIG. 3 is a perspective view of the feeding device for feeding the end of a broken portion of ink ribbon into the cassette.

As best seen in FIGS. 2 and 3, a feeding mechanism, indicated generally by the reference numeral 74, is provided adjacent to the entrance opening 72 into the take up chamber 64 for feeding the ink ribbon 28 through the entrance opening 72 and into the take up chamber 64. As best seen in FIG. 3, the feeding mechanism 74 comprises a pair of feed rollers 76 and 78 suitably mounted between the front and rear walls 43 and 44 so that they can rotate. A one way clutch 82 is suitably interconnected between the shaft 80 and a portion of the wall 44 to permit rotation of the shaft 80 in a counter clockwise direction to feed the ribbon 28 into the chamber 64, but prevents rotation of the shaft 80 in the opposite direction. A gear 84 is also mounted on the shaft 80 and meshes with another gear 85 connected to the feed roller 78. The gear 84 also meshes with another gear 86 fixed to the printing mechanism of the mailing machine, so that when the cassette 34 is inserted into the printing mechanism, the gear 86 drives the gear 84 to drive the feed rollers 76 and 78 during printing operations. The one way clutch 82 prevents reverse rotation of the rollers 76 and 78 so that used ink ribbon 28 cannot be withdrawn from the take up chamber and reused to print unauthorized postage indicia. A finger knob 88 is mounted on the other end of the shaft 80 to permit manual rotation of the feed roller 76 and hence also the other feed roller 78. Both feed rollers 76 and 78 are provided with a plurality of annular grooves 90, and a corresponding plurality of suitable spring fingers 92 are suitably mounted on adjacent wall portions of the upwardly projecting portions 52 and 56 of the bottom wall 42 so that the ends of the fingers 92 ride in the grooves 90 to prevent the ink ribbon 28 from winding around either of the rollers 76 or 78 while feeding the ink ribbon into the chamber 64.

It will be apparent from the foregoing description that the cassette 34 offers several unique advantages over prior art cassettes that both diminish the likelihood that ink ribbons will break, and provide a way of repairing the ink ribbon within the cassette if it should break so that the unused portion of the ink ribbon in the supply chamber can be used. In conventional cassettes which have a driven take up spool, the tension on the ribbon is the greatest when the diameter of the take up spool is the smallest, with the result that the ribbon is most likely to break when a new cassette is first put into service. With the cassette 34, there is no take up spool, so this problem is eliminated. Further, the feed rollers 76 and 78, as well as the gears 84, 85 and 86 are all of relatively small diameter, as a result of which the uniformity of speed of operation can be more precisely controlled than with large diameter feed rollers, or with a take up roller, so that it is possible to minimize shock loads on the ink ribbon resulting from sudden change in velocity of the ink ribbon. Still further, if the ribbon does break, the user need only remove the cassette 34 from the printing mechanism, feed the broken end of the unused portion of the ink ribbon into the nip of the feed rollers 76 and 78, and turn the knob 88 until a small amount of ink ribbon has been fed into the take up chamber 64, and return the cassette to the printing mechanism.

Figure 4:
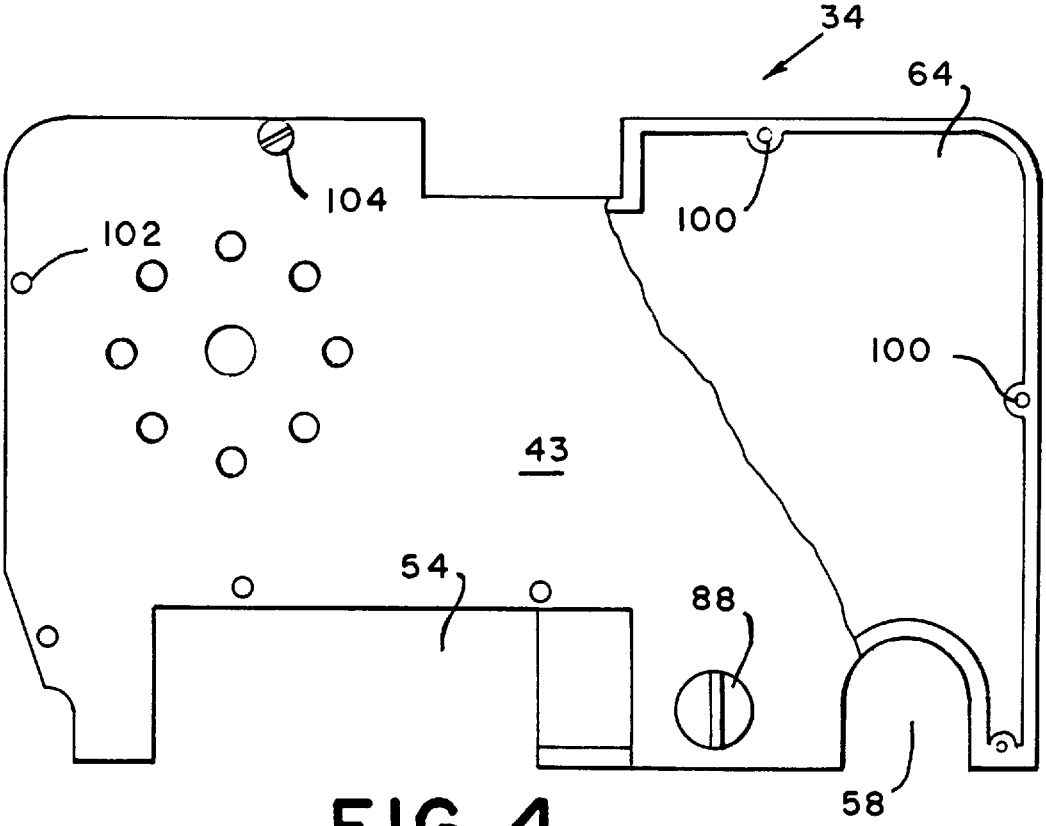
FIG. 4 is a front view of a modified form of cassette which can be opened by a user to permit fresh ink ribbons to be inserted in the cassettes.

FIG. 4 illustrates an enhancement of the cassette 34 in that the front wall 43 is shown as being removable from the rest of the cassette. Thus, the top 36, end 38, 40 and bottom walls 42 are provided with a plurality of holes 100, and the front wall 42 is provided with a plurality of holes 102 through which suitable connectors 104 are inserted into the holes 100. By making the front wall removable, it is possible for a user to purchase one cassette with a spool 66 of ink ribbon already mounted in the supply chamber 62 therein with the purchase of a mailing machine, together with a number of replacement ribbons. When the ribbon in the cassette is consumed, the user merely removes the front wall 43, removes the rumpled up used ink ribbon from the take up cavity 64, inserts a new spool 66 of ink ribbon in the supply cavity 62, threads the lead end of the ink ribbon through the exit opening 70, across the bottom of the cassette and inserts the lead end into the entrance opening 72 to the nip of the feed rollers 76 and 78, in much the same manner as reinserting the end of the unused portion of a broken ink ribbon as described above, and then turns the finger knob 88 to feed a short amount of ink ribbon into the take up cavity.

Figure 5:
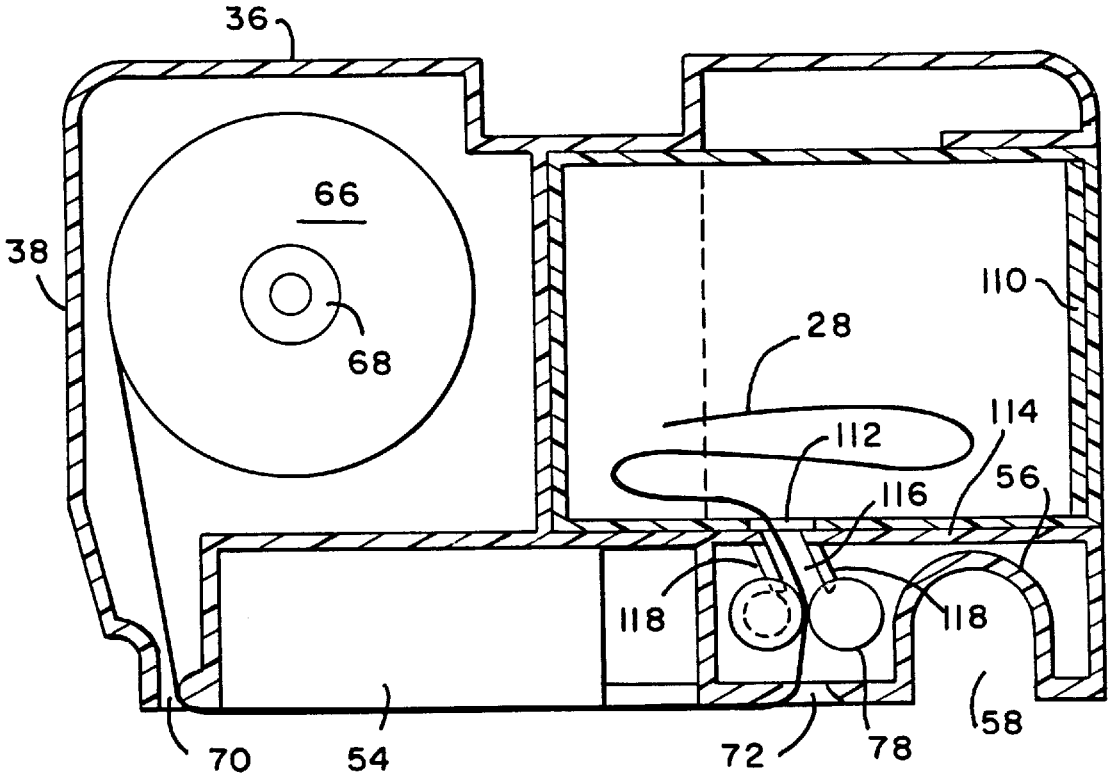
FIG. 5 is a view similar to FIG. 2 showing a further modification of the cassette in which used ink ribbon is stored in a disposable container.

A still further enhancement of the cassette 34 is to provide a disposable container within the take up cavity 64 in which the used ribbon is collected for disposal without the user having to handle the ribbon. Thus, as seen in FIG. 5, a container 110 is positioned within the take up chamber 64, the bottom wall of the container 110 having a narrow slit 112 through which the ink ribbon 28 is inserted by the feed rollers 76 and 78. In this embodiment, the cassette has an intermediate wall 114 which extends across the bottom of the take up chamber 64, the wall 114 having a narrow slit 116 which is contiguous with the slit 112 on the container 110. The fingers 90 of the previous embodiment are replaced with suitable upstanding guide fingers 118 which direct the incoming ink ribbon 28 upwardly through the slit 116 in the wall 114 and the slit 112 in the container 110. When the supply of ink ribbon is consumed, the user merely has to remove the front wall 43 and then remove the container 110 to dispose of the used ink ribbon and insert a fresh ribbon spool. This has the advantage that the user need not have to handle the rumpled used ink ribbon, thereby avoiding contaminating his or her hands with the ink. The container 110 may be simply a cardboard box in which new ribbon can be shipped, or a hard plastic container which would provide some security against a user removing the ribbon from the container and reusing it.

It is to be understood that the present invention is not to be considered as limited to the specific embodiments described above and shown in the accompanying drawings, which are merely illustrative of the best modes presently contemplated for carrying out the invention and which are susceptible to such changes as may be obvious to one skilled in the art, but rather that the invention is intended to cover all such variations, modifications and equivalents thereof as may be deemed to be within the scope of the claims appended hereto.

We claim:

1. A ink ribbon cassette for a mailing machine comprising:

a housing comprising a plurality of exterior walls and a common interior wall defining a supply chamber and a collection chamber;

a spindle fixed in said supply chamber;

a ribbon spool rotatably mounted on said spindle;

an inked ribbon having secured and lead ends, the secured end wound onto said ribbon spool and the lead end for collection in said collection chamber, said inked ribbon rotatably mounted on said ribbon spool;

an exit opening from said supply chamber defined in one of the plurality of exterior walls adjacent to the supply chamber, said exit opening having a rounded edge for guiding said inked ribbon;

an entrance opening to said collection chamber defined in one of the plurality of exterior walls adjacent to the collection chamber, said entrance opening having an edge for guiding the inked ribbon; and a plurality of rollers mounted in said collection chamber adjacent to said entrance opening so that said rollers feed the inked ribbon into said collection chamber: said plurality of rollers further comprise a plurality of annular grooves and said housing further comprises a plurality of fingers mounted on said housing and projecting into said plurality of annular grooves to prevent the ink ribbon from wrapping around said plurality of rollers.

2. The ink ribbon cassette as claimed in claim 1 further comprising an exterior recess adjacent to said supply and collection chambers for accommodating a print head.

3. The ink ribbon cassette as set forth in claim 1 wherein said plurality of rollers further comprises a knob mounted on one of said rollers for manually rotating said plurality of rollers for manually feeding the ink ribbon into said collection chamber.

4. The ink ribbon cassette as set forth in claim 1 wherein one of said plurality of feed rollers further comprises a gear for engagement with a drive gear mounted on a printing mechanism of a mailing machine when said cassette is inserted into the mailing machine.

5. The ink ribbon cassette as set forth in claim 1 wherein a one way clutch is interposed between said plurality of rollers and said housing to prevent reverse rotation of said plurality of rollers and to prevent the ink ribbon from being withdrawn from said collection chamber.

6. The ink ribbon cassette as claimed in claim 1 wherein said plurality of walls includes a removably mounted wall for facilitating replacement of the ink ribbon.

7. The ink ribbon cassette as claimed in claim 6 wherein said cassette includes a removable collection container positioned in said collection chamber for receiving the ink ribbon that is fed into said entrance opening, said removable collection container having an aperture aligned with said entrance opening.

* * * * *